US009579006B1

(12) United States Patent
Kirkpatrick et al.

(10) Patent No.: US 9,579,006 B1
(45) Date of Patent: Feb. 28, 2017

(54) COMPUTER CHASSIS PENETRATION VACUUM HEAD

(71) Applicant: International Business Machines Corporation, Armonk, NY (US)

(72) Inventors: Derrick D. Kirkpatrick, Austin, TX (US); Joseph R. Wilding, Round Rock, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/018,136

(22) Filed: Feb. 8, 2016

(51) Int. Cl.
*A47L 9/06* (2006.01)
*A47L 9/02* (2006.01)

(52) U.S. Cl.
CPC ..... *A47L 9/0666* (2013.01); *A47L 9/066* (2013.01); *A47L 9/0633* (2013.01); *A47L 9/0693* (2013.01)

(58) Field of Classification Search
CPC .... A47L 9/0666; A47L 9/0693; A47L 9/0633; A47L 9/064; A47L 9/0653; A47L 9/066; A47L 9/244
USPC ..... 15/415.1, 416, 304, 371, 397, 406; 403/166
See application file for complete search history.

(56) References Cited

U.S. PATENT DOCUMENTS 4,653,137 A * 3/1987 Fleischhauer ..... A47L 9/06 15/374
6,484,357 B1 * 11/2002 Dong ..... A47L 9/06 15/397
7,036,184 B2 * 5/2006 Kim ..... A47L 9/06 15/397
8,931,135 B1 1/2015 Sangster
2002/0170140 A1 11/2002 Diaz et al.
2006/0090289 A1 5/2006 Kuang
2012/0118327 A1 5/2012 Mazmanyan
2012/0198651 A1 8/2012 Davis

FOREIGN PATENT DOCUMENTS

DE 3915485 A1 10/1990
DE 20020167 U1 3/2001
DE 102010000164 A1 * 7/2011 ..... A47L 9/02

OTHER PUBLICATIONS

Glodeals, "Glodeals Professional Powerful Computer Laptop Keyboard Mini Vacuum Cleaner Battery Powered Dust Cleaner Dust Collector Tool (black)," downloaded from <http://www.amazon.com/Glodeals-Professional-Powerful-Computer-Collector/dp/B00VTEA6DW/ref=zg_bs_3012915011_13> on Jun. 25, 2015, 2 pages.

* cited by examiner

*Primary Examiner* — Bryan R Muller
(74) *Attorney, Agent, or Firm* — Patterson + Sheridan, LLP

(57) ABSTRACT

Method and apparatus for cleaning an interior volume of an electrical component are provided. The apparatus includes a housing with vacuum pins extending from apertures in the housing. The vacuum pins are arranged and sized to fit through ventilation holes in a chassis of the electrical component. The vacuum pins are individually retractable so that a vacuum pin that encounters a structure in the interior volume of the electrical component does not impede remaining vacuum pins from further entering the volume. A vacuum source is attachable to the housing and applies a vacuum to the interior volume through the vacuum pins.

15 Claims, 9 Drawing Sheets

COMPUTER CHASSIS PENETRATION VACUUM HEAD

BACKGROUND

The present disclosure relates to a cleaning apparatus, and more specifically, to an attachment for a vacuum cleaner that can access an interior volume of a computer chassis through ventilation holes.

SUMMARY

According to one embodiment, an apparatus includes a housing having a first side, a second side, and defining a plenum therein. The first side includes a plurality of apertures therethrough. The plurality of apertures are in communication with the plenum. The second side includes a port configured to be connectable to a vacuum source. The apparatus also includes a plurality of vacuum pins arranged in respective ones of the plurality of apertures. Each of the plurality of vacuum pins includes a base portion engaging an aperture and a tip end extending away from an outward-facing surface of the first side. The vacuum pins include passages therethrough from the tip end to the base portion. The vacuum pins are moveable between a first position and a second position relative to the apertures. The tip ends extend away from the outward-facing surface of the first side by a greater amount in the first position than the second position.

According to one embodiment, a vacuum kit includes a plurality of vacuum housings. Each vacuum housing includes a housing having a first side, a second side, and defining a plenum therein. The first side includes a plurality of apertures therethrough. The plurality of apertures are in communication with the plenum. The second side includes a port configured to be connectable to a vacuum source. Each vacuum housing also includes a plurality of vacuum pins arranged in respective ones of the plurality of apertures. Each of the plurality of vacuum pins includes a base portion engaging an aperture and a tip end extending away from an outward-facing surface of the first side. The vacuum pins include passages therethrough from the tip end to the base portion. The vacuum pins are moveable between a first position and a second position relative to the apertures. The tip ends extend away from the outward-facing surface of the first side by a greater amount in the first position than the second position. At least one of a pattern of the apertures, a spacing of the apertures, a cross-sectional dimension of the vacuum pins, and a cross-sectional shape of the vacuum pins for the respective ones of the plurality of vacuum housings differs from remaining ones of the plurality of vacuum housings.

According to one embodiment, a method for cleaning an interior of an electrical component includes aligning a plurality of vacuum pins of a vacuum device with a first portion of ventilation holes of a chassis of an electrical component. The method also includes moving the aligned vacuum device and vacuum pins toward the chassis such that the vacuum pins are inserted through the first portion of ventilation holes and tip ends of the vacuum pins extend into an interior volume of the electrical component. The method also includes operating the vacuum source such that debris in the interior of the electrical component is urged through the vacuum pins, through the plenum, and to the vacuum source.

DETAILED DESCRIPTION

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s). Likewise, reference to "the invention" or "the disclosure" shall not be construed as a generalization of any inventive subject matter disclosed herein and shall not be considered to be an element or limitation of the appended claims except where explicitly recited in a claim (s).

Electronic equipment, such as computers, typically requires periodic cleaning to remove dust and/or other debris that may accumulate on internal components over time. For example, dust may accumulate on heatsinks and/or cooling fins over time. Such dust accumulation can reduce the effectiveness of the heatsinks and/or cooling fins, causing computer processors or other electrical components cooled by the heatsinks to operate at increased temperatures. Removing the dust and/or other debris from internal components can be a time-consuming process. Typically, a computer has to be shut down and a chassis of the computer has to be opened or removed to facilitate cleaning. In addition to being a time-consuming undertaking, such cleaning removes a computer from use during the cleaning procedure. In the instance of a computer used in a computer server, such as a blade server computer, the processing capability of the computer server is reduced while such cleaning procedures are taking place.

In embodiments described herein, an apparatus for cleaning an interior volume of an electronic component, such as a computer blade server, is attachable to a vacuum source, such as a hose of a shop vacuum or other vacuum cleaner. The apparatus includes vacuum pins extending from a housing, wherein the vacuum pins can be inserted through the ventilation holes in a chassis of the electronic component. The vacuum pins can apply a vacuum from the vacuum source to the interior volume of the electronic component through the vacuum pins to remove dust and/or other debris.

Figure 1A:
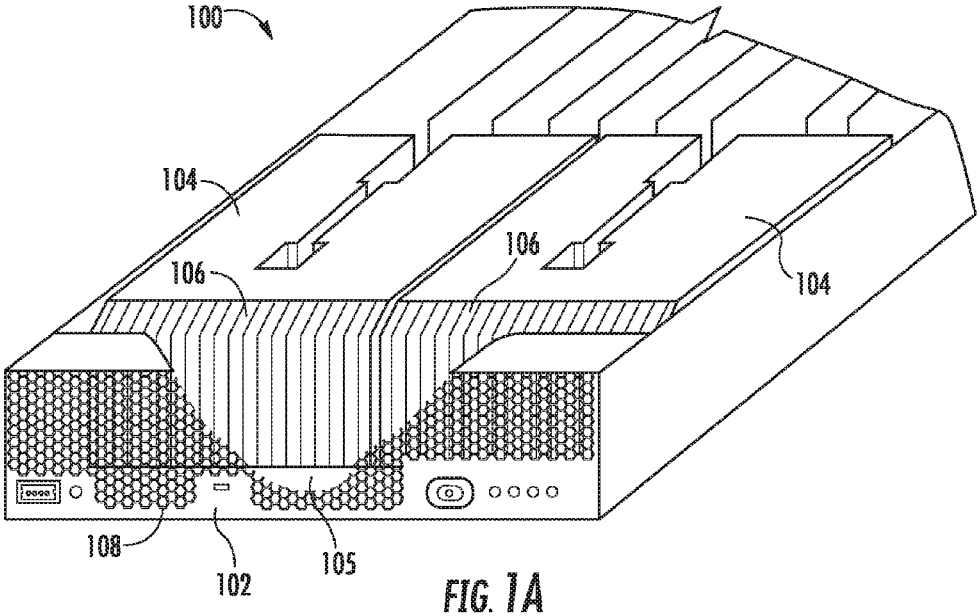
FIG. 1A is a partial cutaway perspective view of a blade server.
Figure 1B:
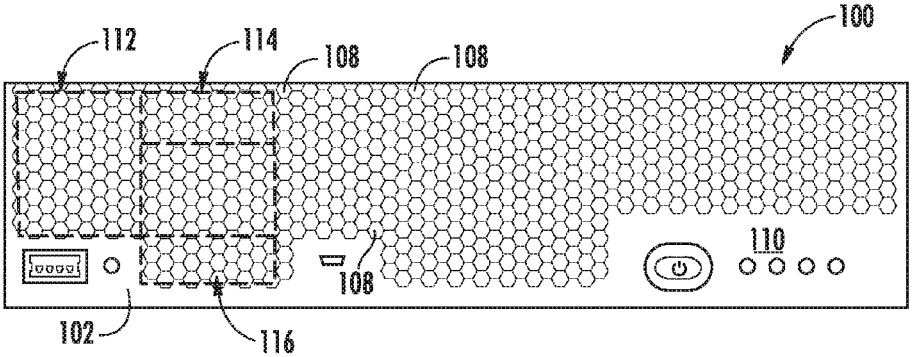
FIG. 1B is a front view of the blade server illustrated in FIG. 1A.
Figure 1C:
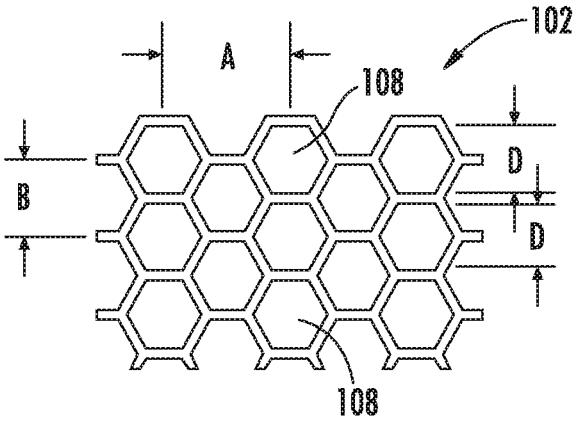
FIG. 1C is a detail view of ventilation holes of the blade server illustrated in FIG. 1A.

FIGS. 1A-1C illustrate a computer chassis 100 that includes heatsinks 104 and cooling fins 106 in an interior volume 105. The heatsinks 104 and cooling fins 106 cool internals components, such as computer processors or other electronics in the computer chassis 104. The computer chassis 100 also includes a front face 102 that includes ventilation holes 108 through a surface 110. The ventilation holes 108 in the computer chassis 100 have hexagonal shapes, wherein rows of the ventilation holes 108 are offset from adjacent rows of ventilation holes 108. Referring to FIG. 1C, in various embodiments, the ventilation holes could have different sizes and/or spacing therebetween. For example, adjacent ventilation holes in the same row could have a pitch of between 0.25 inches and 0.40 inches (as indicated by dimension A). As another example, adjacent rows of holes could have a pitch of between 0.15 inches and 0.34 inches (as indicated by dimension B). As another example, each of the hexagonal ventilation holes 108 could have a dimension between opposing sides of between 0.10 inches and 0.20 inches (as indicated by dimension D). Other ventilation holes could have different spacing and sizes.

Figure 1D:
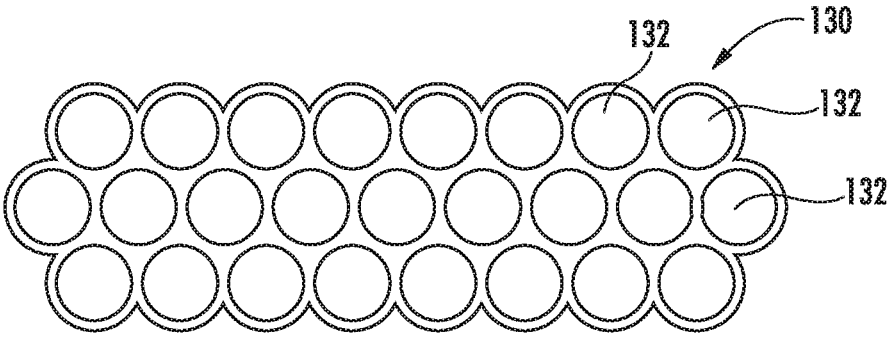
FIG. 1D is a detail view of ventilation holes of a different electronic component.
Figure 1E:
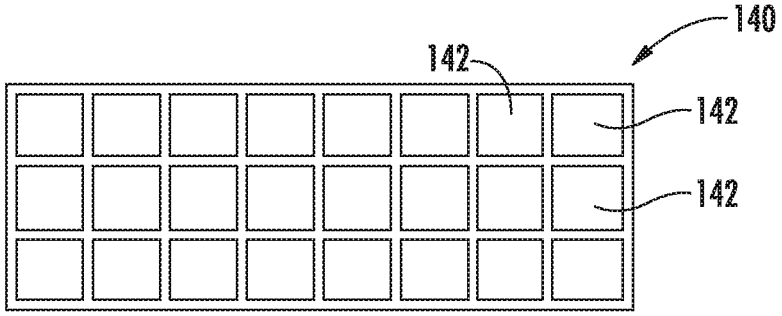
FIG. 1E is a detail view of ventilation holes of a different electronic component.
Figure 1F:
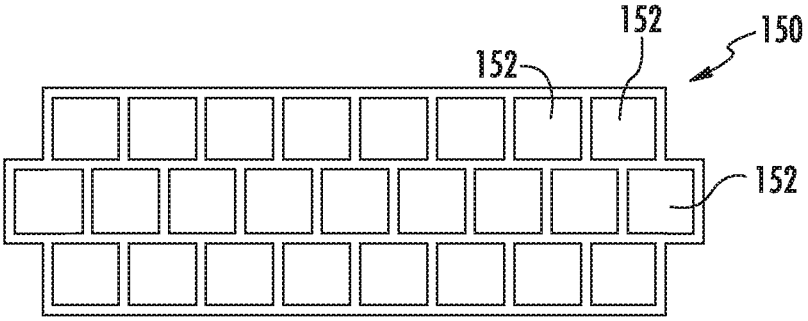
FIG. 1F is a detail view of ventilation holes of another different electronic component.

FIGS. 1D-1F illustrate other examples of ventilation holes and front faces of a computer chassis according to various embodiments. For example, FIG. 1D illustrates a portion of the front face 130 that includes circular ventilation holes 132. The circular ventilation holes 132 are arranged in an offset pattern. FIG. 1E illustrates a portion of another front face 140 that includes square ventilation holes 142. The square ventilation holes 142 are aligned in rows and columns rather than offset. FIG. 1F illustrates a portion of another front face 150 that includes square ventilation holes 152 arranged in an offset pattern.

Figure 2A:
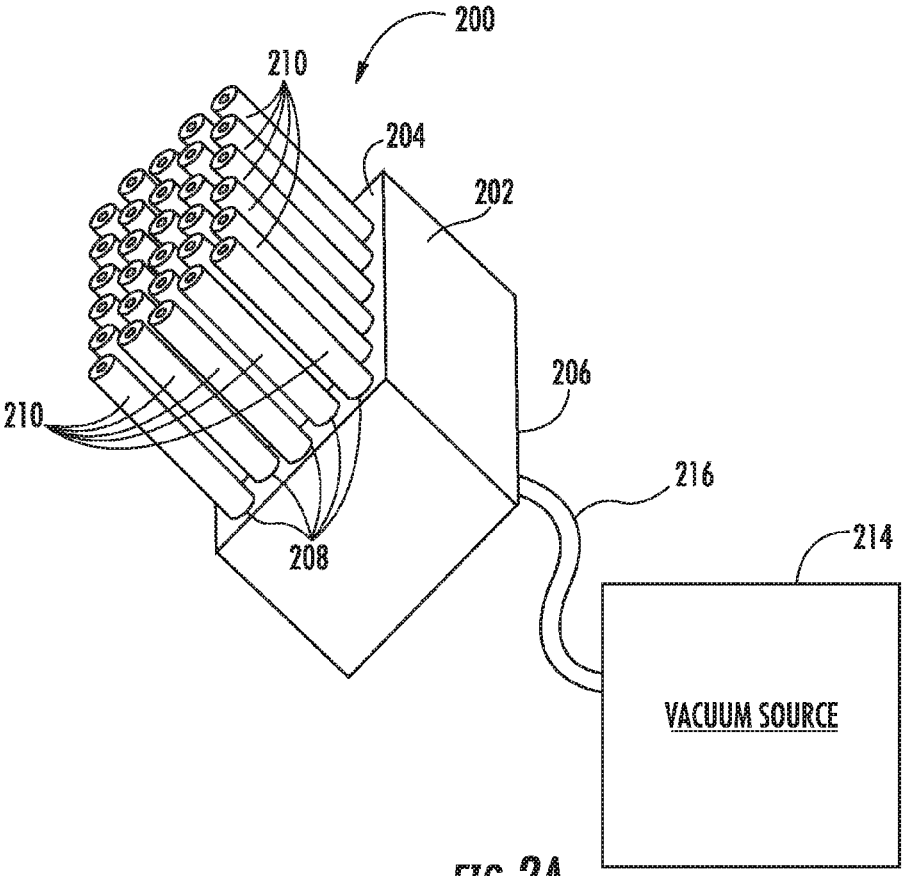
FIG. 2A is a perspective view of an apparatus for cleaning an interior volume of an electronic component.
Figure 2B:
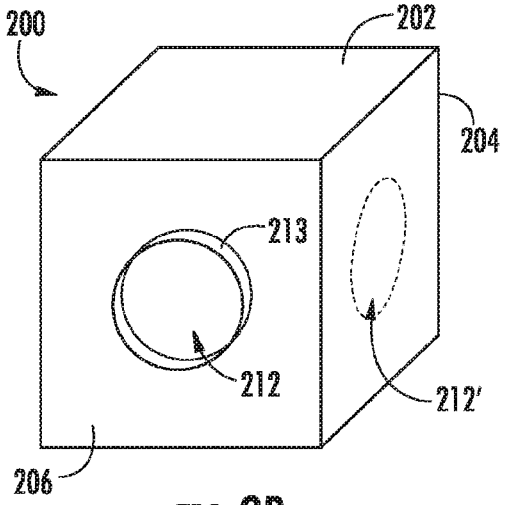
FIG. 2B is a second perspective view of the apparatus of FIG. 2A, wherein a different side of the apparatus is illustrated.
Figure 2C:
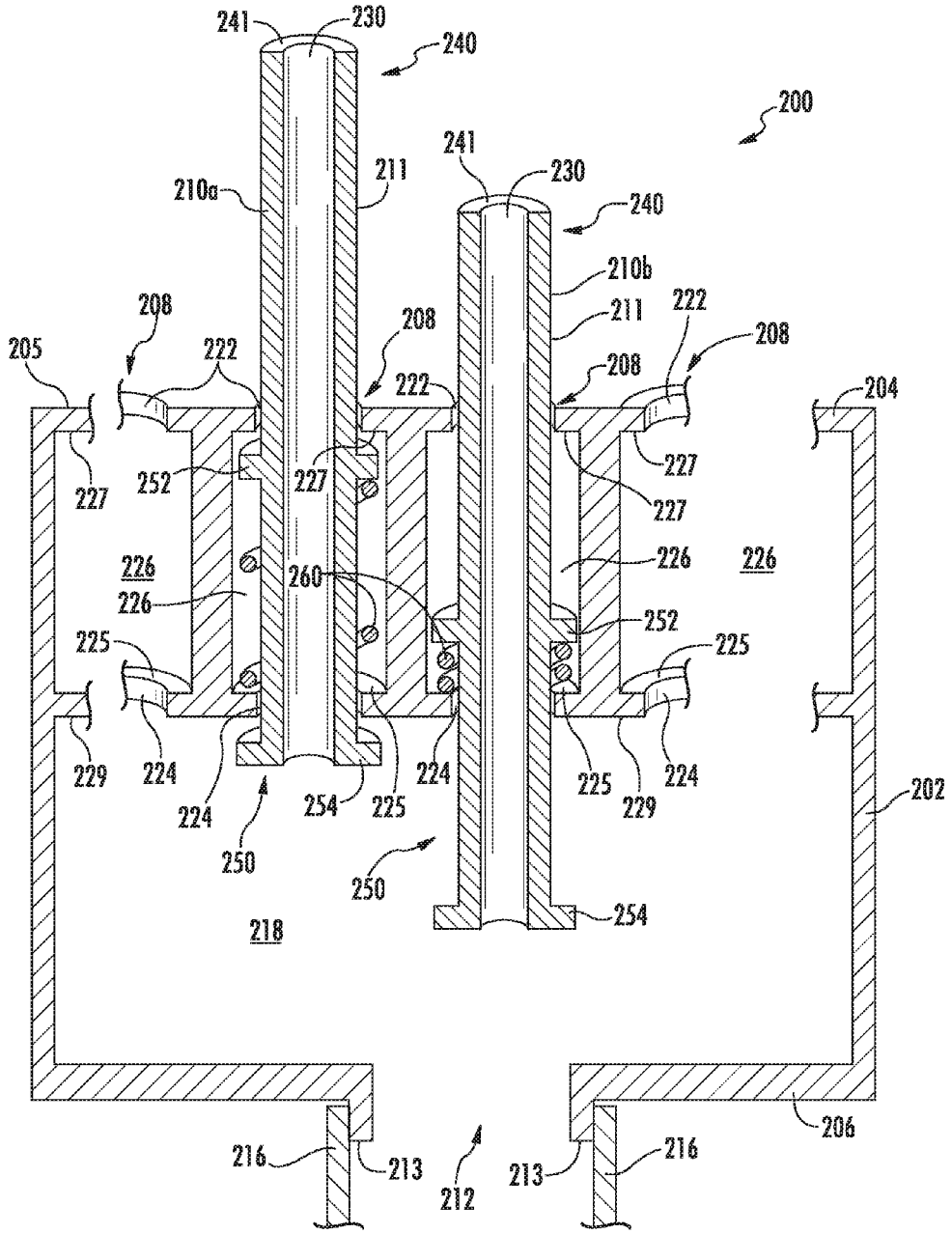
FIG. 2C is a partial cross-sectional side view of the apparatus of FIG. 2A.

FIGS. 2A-2C illustrate an apparatus 200 according to at least one embodiment that includes vacuum pins 210 configured to extend through ventilation holes (e.g., the ventilation holes 108 in the front face 102 of the computer chassis 100 illustrated in FIGS. 1A-1F. The apparatus 200 includes a housing 202 with a first side 204 and a second side 206 opposite side 204. While the first side 204 and the second side 206 are shown arranged on opposite sides of the housing 202, in other embodiments, the first side 204 and the second side 206 could be on adjacent sides of the housing 202. The first side 204 of the housing 202 includes a plurality of apertures 208 arranged in a pattern that matches a pattern of the ventilation holes in the front face of the chassis. For example, referring to FIG. 1C, the apertures 208 could be arranged in rows, wherein the apertures 208 in one particular row are offset from the adjacent rows. The apertures 208 could include dimensions (e.g., diameters) that are equal to or slightly less than interior dimensions of the ventilation holes (e.g., dimension D shown in FIG. 1C). Furthermore, the apertures 208 could have the same pitch (e.g., dimensions A and B shown in FIG. 1C) as the ventilation holes.

The vacuum pins 210 are disposed in the apertures and extend from the housing 202. The vacuum pins 210 include similar sizing and pitch as the apertures 208 and therefore can be inserted into the ventilation holes in an electrical component, such as the ventilation holes 108 in the front face 102 of the computer chassis 100. As will be explained in greater detail with respect to FIG. 2C, the vacuum pins 210 are individually retractable into the housing 202 so that if a particular vacuum pin 210 encounters an obstruction in the electrical component, such as a circuit board or a cooling fin, that vacuum pin 210 can retract into the housing 202 to enable remaining vacuum pins 210 to penetrate further into the electrical component. The vacuum pins 210 can be biased toward the extended position (i.e., not retracted into the housing 202).

The housing 202 is attachable to a vacuum source 214 by a hose 216. For example, the vacuum source 214 could be a shop vacuum or other vacuum cleaner that includes a hose 216. The hose 216 can be connected to a port 212 on the second side 206 of the housing 202. Referring to FIG. 2C, the hose 216 could fit over a flange 213 or other fitting, and friction between the hose 216 and the flange 213 could retain the hose 216 on the housing 202.

In use, an operator grasps the housing 202 to align the vacuum pins 210 with ventilation holes in an electrical component, such as the ventilation holes 108 in the computer chassis 100. For example, with reference to FIG. 1B, a user may align the vacuum pins 210 with a first zone 112 of ventilation holes 108. The user can then push the housing 202 toward the surface 110 of the front face 102 of the computer chassis 100 such that the vacuum pins 210 pass through the ventilation holes 108 in the first zone 112 to extend into the interior volume 105 of the computer chassis 100. As described in greater detail below, the vacuum pins 210 can apply a vacuum from vacuum source 214 to the interior volume 105 to remove dust and/or other debris that may be in the interior volume 105. After the interior volume 105 has been cleaned via the ventilation holes 108 in the first zone 112, the user can remove the vacuum pins 210 from the first zone 112 of ventilation holes 108 and reposition the housing with 202 to align with different zones of ventilation holes 108 to clean other portions of the interior volume 105. For example, the user may move the housing 202 such that the vacuum pins 210 align with a second zone 114 of ventilation holes 108 and then later with a third zone 116 of ventilation holes 108. The user may continue to move the housing 202 until all or most of the ventilation holes 108 have been accessed to clean the interior volume 105 of the computer chassis 100.

Referring primarily to FIG. 1A, the interior volume 105 of the computer chassis 100 may have an irregular size and shape. For example, the illustrated cooling fins 106 extend from the heatsinks 104 toward the front face 102 at discrete locations. A first of the vacuum pins 210 extending through a ventilation hole 108 may encounter a cooling fin 106 whereas a second of the vacuum pins 210 may be positioned between adjacent cooling fins 106. To allow for increased penetration into the interior volume 105 by the vacuum pins 210, the vacuum pins 210 are individually retractable into the housing 202.

FIG. 2C is a partial cross-sectional side view of the apparatus 200 and illustrates a first vacuum pin 210*a* in a first position and a second vacuum pin 210*b* in a second position (the vacuum pins 210*a* and 210*b* are collectively referred to as vacuum pins 210). The first vacuum pin 210*a* and the second vacuum pin 210*b* are disposed in respective apertures 208 in the housing 202. The housing 202 includes a plenum 218 in communication with the port 212 and with the vacuum pins 210 in the apertures 208. The apertures 208 include respective proximal openings 224 and distal openings 222, wherein the terms proximal and distal are with reference to the plenum 218. The apertures 208 include an interior 226 between the proximal opening 224 and the distal opening 222.

Each of the vacuum pins 210 includes a body 211 that includes a tip end 240 and a base portion 250. The base portion 250 includes a first ridge 252 extending from the body 211 along the body 211 and a second ridge 254 arranged at a proximal end 251 of the body 211. The first ridge 252 is disposed in the interior 226 of an aperture 208. The proximal opening 224 and the distal opening 222 are smaller than an exterior dimension of the first ridge 252 such that the first ridge 252 is retained in the interior 226 of the aperture 208. The second ridge 254 is positioned in the plenum 218 and includes an exterior dimension that is larger than the proximal opening 224 such that the second ridge 254 cannot pass through the proximal opening 224 to the interior 226 of the aperture 208. The first ridge 252 and the second ridge 254 limit movement of the vacuum pins 210 with respect to the housing 202. For example, the first ridge 252 can abut an interior distal surface 227 in the interior 226 of an aperture 208, which prevents further movement of the vacuum pin 210 in the distal direction. Furthermore, the second ridge 254 can abut an interior surface 229 of the plenum 218 which also prevents further movement of the vacuum pin 210 in the distal direction. In various embodiments, the second ridge 254 could be omitted.

In various embodiments, each of the vacuum pins 210 can have an associated biasing member 260 that urges the vacuum pin toward the first position (i.e., extended in the distal direction, like vacuum pin 210*a*). In at least one embodiment, the biasing members 260 are springs arranged around the bodies 211 of the respective vacuum pins 210. In other embodiments, the biasing members 260 could be an elastomeric material and/or a resilient material, such as a rubber material or a plastic foam material. The biasing members 260 can be arranged between the first ridges 252 of the vacuum pins 210 and a proximal interior surface 225 of the interiors 226 of the respective apertures 208. In the event a particular vacuum pin 210 is pushed into the housing 202 (e.g., retracted in the proximal direction toward the second position, such as the vacuum pin 210*b*) when the vacuum pin 210 encounters an obstruction in the interior volume 105, the biasing member 260 exerts an opposing force that urges the retracted vacuum pin 210 in the distal direction (i.e., toward the first position). When the housing 202 is thereafter removed from the computer chassis 100, the opposing force of the biasing member 260 returns the retracted vacuum pin 210 to the first position (e.g., the position of the vacuum pin 210*a* illustrated in FIG. 2C).

Still referring to FIG. 2C, a vacuum flow path from the port 212 extends to the plenum 218 and then through passages 230 in the respective vacuum pins 210. When the vacuum pins 210 are inserted into the interior volume 105 of the computer chassis 100 (or into an interior volume of another electrical component), dust or other debris in the interior volume 105 in the computer chassis 100 can be drawn through the passages 230 at the tip ends 240 of the vacuum pins 210, through the plenum 218, and through the port 212 and into the hose 216 of the vacuum source 214. Various embodiments described herein minimize or reduce airflow through the proximal opening 225 and the distal opening 222 of the apertures 208. Such airflow may be minimized or reduced by closely fitting the vacuum pins 210 and the apertures 208. For example, the vacuum pins may be cylindrical, as shown in FIG. 2C, and have an exterior diameter of 0.16 inches. The proximal openings 224 and distal openings 222 of the apertures 208 could have a slightly larger diameter, such as 0.17 inches.

The vacuum source 214 drawing air from the plenum 218 via the hose 216 results in relatively low pressure in the plenum 218 and a pressure differential from the second side 204 of the housing 202 to the plenum 218. Stated differently, the pressure at the second side 204 of the housing 202 is higher than the pressure in the plenum 218. This pressure differential, applied to the first ridge 252 of the vacuum pins 210, could urge the vacuum pins 210 toward the second position (i.e., the position of the vacuum pin 210*b* illustrated in FIG. 2C). To ensure that the pressure differential does not urge the vacuum pins 210 toward the second position, the biasing members 260 could exert sufficient force to overcome any pressure-induced forces in at least one embodiment. However, in certain circumstances, it may be undesirable to use a biasing member 260 that exerts a large force. For example, with the interior volume 105 including extremely delicate components, it could be undesirable to insert vacuum pins 210 that must be pressed with a relatively large amount of force against such delicate components to cause the vacuum pins 210 to retract toward the second position. In various embodiments, the first ridge 252 of the vacuum pins 210 could have an exterior dimension that is substantially smaller than dimensions of the interiors 226 of the respective apertures 208, resulting in a gap between the first ridges 252 and the interiors 226 of the apertures 208. The gaps create a flow path for air that can eliminate or reduce any pressure differential across the first ridge 252.

Figure 3:
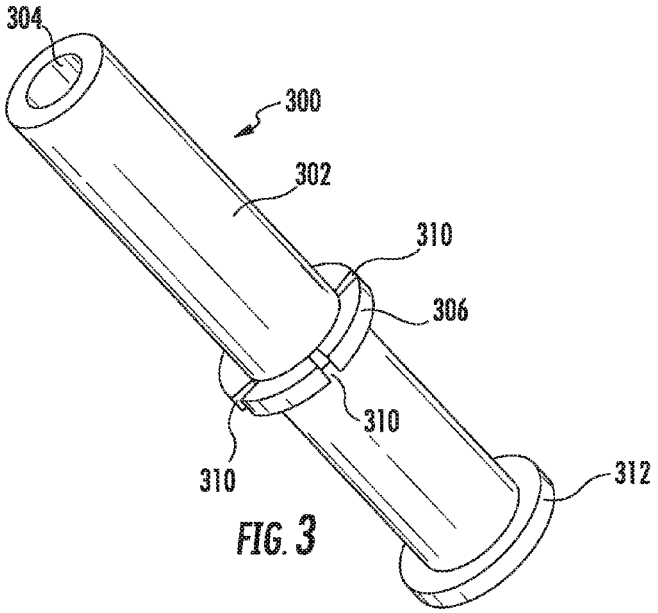
FIG. 3 is a perspective view of a vacuum pin according to one embodiment.

FIG. 3 illustrates another embodiment of a vacuum pin 300 that includes a cylindrical body 302 with a passage 304 formed therethrough, wherein the body 302 includes a first ridge 306 and a second ridge 312 there around. The first ridge 306 differs from the first ridge 252 of the vacuum pin 210 shown in FIG. 2C by having discontinuities 310 therearound. The discontinuities 310 create a flow path for air that can eliminate or reduce any pressure differential across the first ridge 306.

Figure 4A:
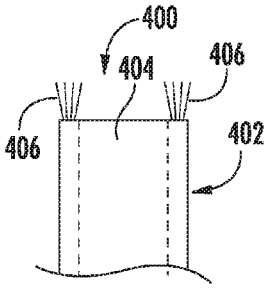
FIG. 4A is a cross-sectional side view of a tip end of a vacuum pin according to one embodiment.

Referring again to FIG. 2C, the tip ends 240 of the illustrated vacuum pins 210 have substantially flat surfaces 241. Such flat surfaces 241 could be disadvantageous in certain circumstances where the tip ends 240 may encounter a flat surface in the interior volume 105 of the computer chassis 100. In such circumstances, the flat surfaces 241 of the tip ends 240 could be positioned flush with the flat surface in the interior volume 105 on insertion, which would eliminate flow through the particular passage 230 in the affected vacuum pin 210, reducing the amount of dust and/or other debris removed by the apparatus 200. FIGS. 4A-4E illustrate various alternative tip ends for vacuum pins that could be advantageous in certain circumstances. For example, FIG. 4A illustrates a vacuum pin 400 wherein a tip end 402 includes bristles 406 arranged around a passage 404 through the vacuum tip 400. The bristles 406 could create separation from any objects or surfaces within the interior volume 105 of the computer chassis 100. The bristles 406 could also mechanically dislodge any dust and/or debris on surfaces in the interior volume 105 of the computer chassis 100, thereby providing additional or improved cleaning.

Figure 4B:
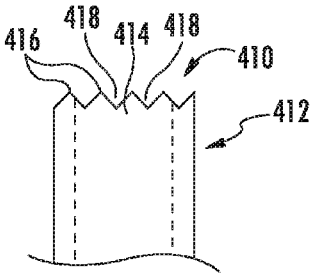
FIG. 4B is a cross-sectional side view of a tip end of a vacuum pin according to another embodiment.

As another example, FIG. 4B illustrates a vacuum pin 410 wherein a tip end 412 includes a serrated edge 416 around a passage 414 through the vacuum pin 410. The serrated edge 416 provides flow paths 418 to the passage 414 in the event the tip end 412 encounters a flat surface in the interior volume 105 of the computer chassis 100.

Figure 4C:
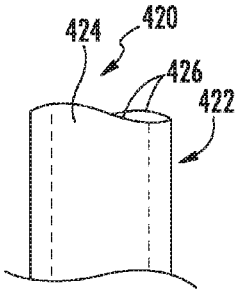
FIG. 4C is a cross-sectional side view of a tip end of a vacuum pin according to yet another embodiment.

As yet another example, FIG. 4C illustrates a vacuum pin 420 wherein a tip end 422 includes an undulating edge 426 around a passage 424 through the vacuum pin 420. The undulating edge 426 provides flow paths to the passage 424 in the event the tip end 422 encounters a flat surface in the interior volume 105 of the computer chassis 100.

Figure 4D:
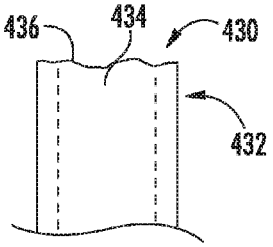
FIG. 4D is a cross-sectional side view of a tip end of a vacuum pin according to yet another embodiment.

As yet another example, FIG. 4D illustrates a vacuum pin 430 wherein a tip end 432 includes an irregular edge 436 around a passage 434 through the vacuum pin 430. The irregular edge 436 provides flow paths to the passage 434 in the event the tip end 432 encounters a flat surface in the interior volume 105 of the computer chassis 100.

Figure 4E:
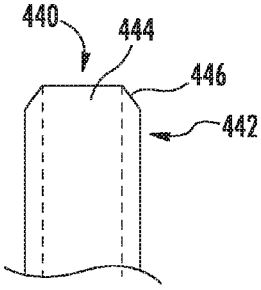
FIG. 4E is a cross-sectional side view of a tip end of a vacuum pin according to yet another embodiment.

As another example, FIG. 4E illustrates a vacuum pin 440 wherein a tip end 442 includes a mitered edge 446 around a passage 444 through the vacuum pin 440. The mitered edge 446 could make it easier for the vacuum pin 440 to slide along or next to an obstruction in the interior volume 105 of the computer chassis 100.

Figure 5:
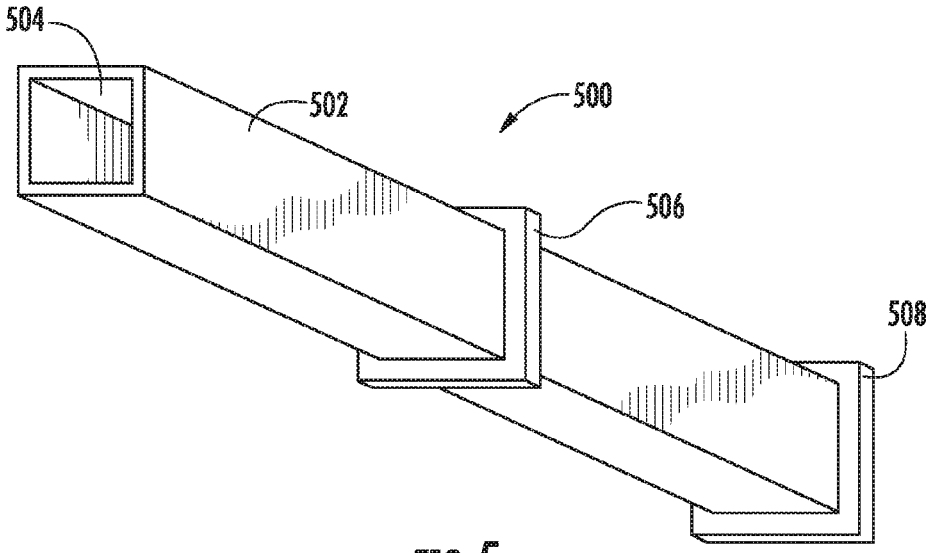
FIG. 5 is a perspective view of a vacuum pin according to another embodiment.

The vacuum pins 210 of the apparatus 200 are illustrated above as being cylindrical with passages having circular cross-sectional profiles. In various embodiments, the vacuum pins could have other shapes. For example, FIG. 5 illustrates a vacuum pin 500 with a square-shaped body 502 and a passage 504 having a square cross-sectional profile. The vacuum pin 500 also includes a square first ridge 506 and a square second ridge 508. The square vacuum pin 500 could be advantageous for use with a computer chassis (or other electrical component) having square ventilation holes, such as the square ventilation holes 142 shown in FIG. 1E or with the square ventilation holes 152 shown in FIG. 1F. In certain embodiments, it may be advantageous for the square vacuum pin 500 to include a square body 502 and square ridges 506 and 508, but to have a passage with a circular cross-sectional profile, such as the passage 230 illustrated in FIG. 2C. In embodiments of the apparatus 200 that use a square vacuum pin 500, the apertures in the housing 202 would have square proximal openings and distal openings.

Figure 6:
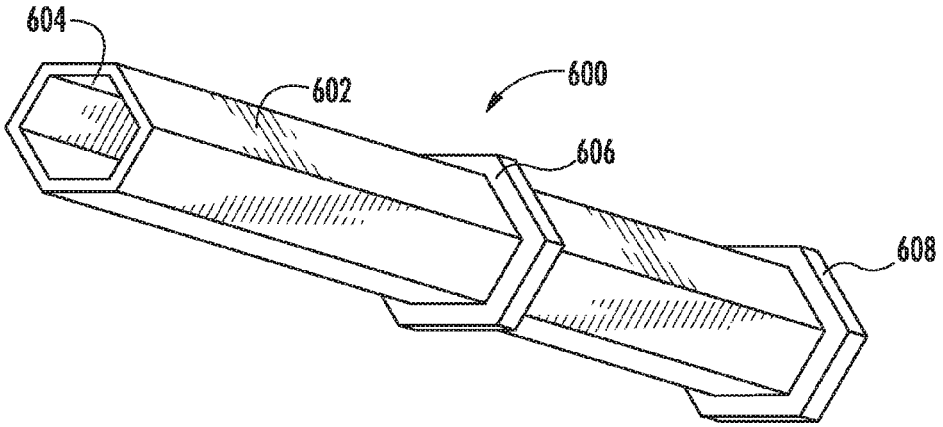
FIG. 6 is a perspective view of a vacuum pin according to another embodiment.

FIG. 6 illustrates another exemplary vacuum pin 600 with a hexagonal shaped body 602 and a passage 604 having a hexagonal cross-sectional profile. The vacuum pin 600 also includes a hexagonal first ridge 606 and a hexagonal second ridge 608. The hexagonal vacuum pin 600 could be advantageous for use with a computer chassis (or other electrical component) having hexagonal ventilation holes, such as the hexagonal ventilation holes 108 shown in FIGS. 1A-1C. In certain embodiments, it may be advantageous for the hexagonal vacuum pin 600 to include a hexagonal body 602 and hexagonal ridges 506 and 508, but to have a passage with a circular cross-sectional profile, such as the passage 230 illustrated in FIG. 2C. In embodiments of the apparatus 200 that use a hexagonal vacuum pin 600, the apertures in the housing 202 would have hexagonal proximal openings and distal openings.

Referring again to FIG. 2C, in various embodiments, a kit of vacuum attachments, such as the illustrated apparatus 200, is provided. The kit of vacuum attachments can include a plurality of housings, wherein each of the housings has at least one different characteristic from remaining housings. For example, different housings may include vacuum pins with different shapes and/or sizes. As another example, different housings could have apertures and vacuum pins spaced apart with different pitches and/or arranged in different patterns. In use, a particular vacuum attachment with apertures that are sized, spaced, and shaped most similarly to a pattern of ventilation holes for an electrical component is selected from the kit and connected to the vacuum source 214. The selected vacuum attachment is then used to clean an interior volume of the electrical component by inserting the vacuum pins of the selected housing through the ventilation holes of the electrical component.

In certain embodiments, an apparatus (e.g., the apparatus 200 shown in FIGS. 2A-2C) could be included with the electrical component. For example, an electrical component (e.g., a blade server) or a plurality of electrical components (e.g., a plurality of blade servers) for sale could include an apparatus 200 configured for use with ventilation holes in the electrical component(s). The included apparatus 200 could then be used for occasional cleaning of the internal volume(s) of the electrical component(s).

Figure 7A:
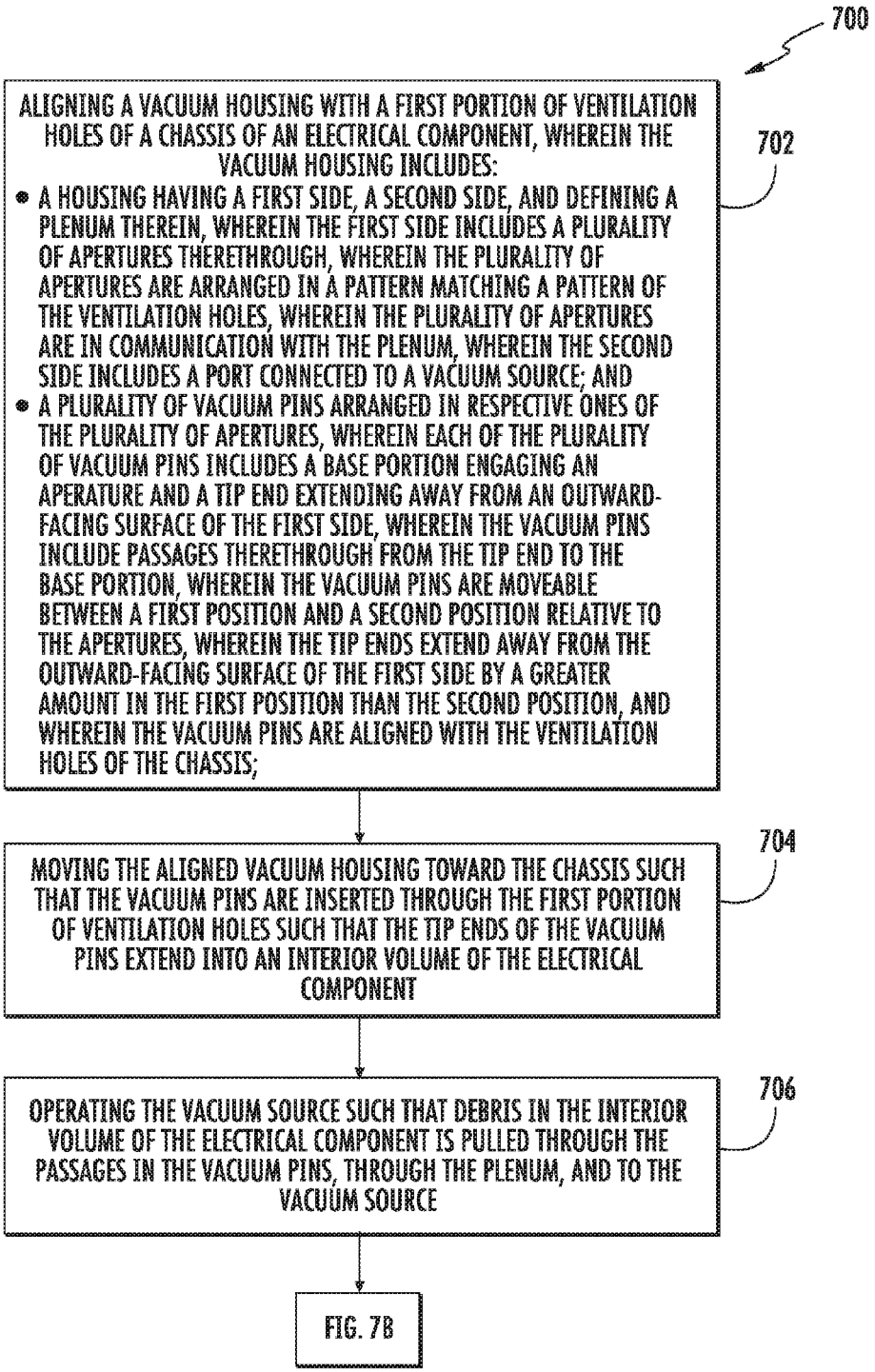
FIG. 7A is a flow chart of a method according to one embodiment.

FIG. 7A illustrates a method 700 for cleaning an interior of an electrical component. In block 702 of the method 700, a vacuum housing is aligned with a first portion of ventilation holes of the chassis of an electrical component. The vacuum housing has a first side, a second side, and a plenum therein. The first side includes a plurality of apertures therethrough, and the plurality of apertures is arranged in a pattern matching a pattern of the ventilation holes. Furthermore, the plurality of apertures is in communication with the plenum. The second side of the housing includes a port connected to a vacuum source. A plurality of vacuum pins is arranged in respective ones of the plurality of apertures. Each of the plurality of vacuum pins includes a base portion engaging an aperture and the tip end extending away from an outward facing surface of the first side. The vacuum pins include passages therethrough from the tip end to the base portion. The vacuum pins are movable between a first position and a second position relative to the apertures. The tip ends extend away from, e.g., are biased towards, the outward facing surface of the first side by a greater amount in the first position than the second position. When the vacuum housing is aligned with the first portion of ventilation holes of the chassis, the vacuum pins are aligned with the ventilation holes of the chassis.

In block 704, the aligned vacuum housing is moved toward the chassis such that the vacuum pins are inserted through the first portion of ventilation holes such that the tip ends of the vacuum pins extend into an interior volume of the electronic device. In block 706, the vacuum source is operated such that dust and/or debris in the interior of the electrical component is pulled through the passages in the vacuum pins, through the plenum, and to the vacuum source.

Figure 7B:
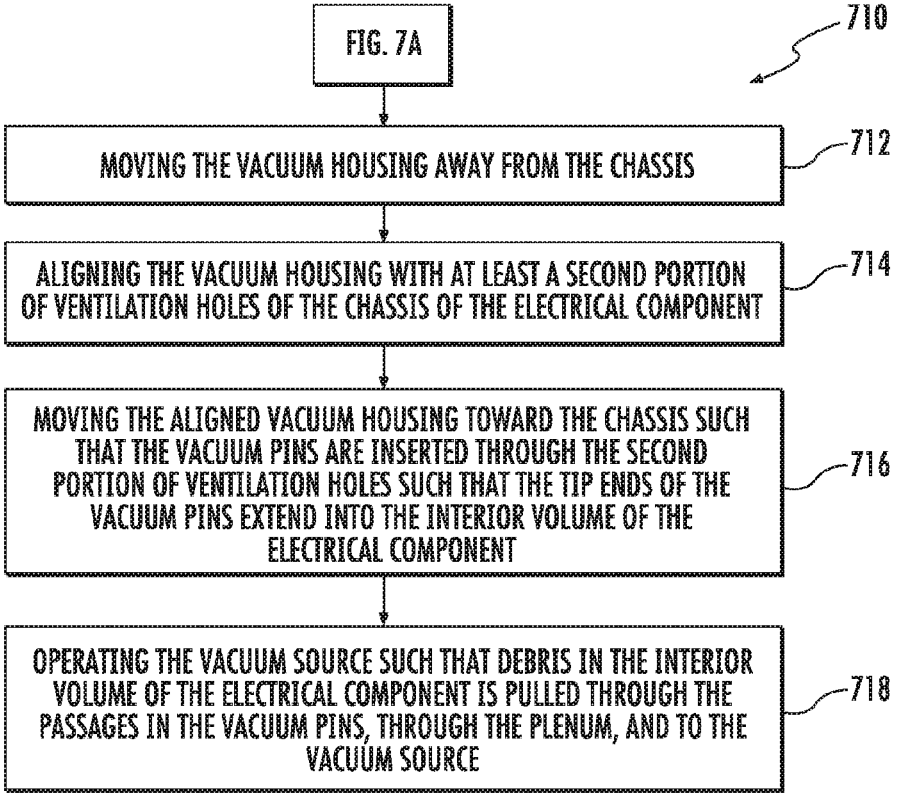
FIG. 7B is a flow chart of additional steps for the method of FIG. 7A, according to one embodiment.

FIG. 7B illustrates an additional method 710 that can be optionally performed after the method 700 shown in FIG. 7A. In block 712, after the vacuum source is operated in block 706, the vacuum housing is moved away from the chassis of the electrical component. In block 714, the vacuum housing is aligned with a second portion of ventilation holes of the chassis of the electrical component. Thereafter, in block 716, the aligned vacuum housing is moved toward the chassis such that the vacuum pins are inserted through the second portion of ventilation holes and such that the tip ends of the vacuum pins extend into the interior volume of the electrical component. In block 718, the vacuum source is operated such that debris in the interior of the electrical component is pulled to the passages in the vacuum pins, through the plenum, and to the vacuum source. Blocks 712-718 can be repeated until all portions or a sufficient number of portions of ventilation holes of the electrical component have been cleaned.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

While the foregoing is directed to embodiments of the present disclosure, other and further embodiments of the invention may be devised without departing from the basic scope thereof, and the scope thereof is determined by the claims that follow.

What is claimed is:

1. An apparatus, comprising:

a housing having a first side, a second side, and defining a plenum therein, wherein the first side includes a plurality of apertures therethrough, wherein the plurality of apertures are in communication with the plenum, wherein the second side includes a port configured to be connectable to a vacuum source; and a plurality of vacuum pins arranged in respective ones of the plurality of apertures, wherein the plurality of apertures include a proximal opening and a distal opening that have dimensions matching dimensions of an exterior surface of the vacuum pins, wherein an interior of the apertures between the proximal opening and the distal opening have dimensions that are larger than the dimensions of the proximal and distal openings, wherein each of the plurality of vacuum pins includes a base portion engaging an aperture and a tip end extending away from an outward-facing surface of the first side, wherein the vacuum pins include passages therethrough from the tip end to the base portion, wherein the vacuum pins are moveable between a first position and a second position relative to the apertures, wherein the tip ends extend away from the outward-facing surface of the first side by a greater amount in the first position than the second position, wherein the vacuum pins include a first ridge extending away from the exterior surface at a location between the proximal and distal openings of the aperture, wherein the vacuum pins include a second ridge extending away from the exterior surface at a location in the plenum such that the proximal opening is between the first ridge and the second ridge, and wherein the first ridge and the second ridge cannot pass through the proximal opening or the distal opening, and wherein the first ridge is discontinuous around a perimeter of the exterior surface of the vacuum pin.

2. The apparatus of claim 1, further comprising biasing members arranged between the proximal opening of the apertures and the first ridge of the vacuum pins, wherein the biasing members urge the vacuum pins toward the first position.

3. The apparatus of claim 2, wherein the biasing members are springs arranged around the vacuum pins between the first ridge and the proximal opening.

4. The apparatus of claim 1, wherein the tip ends of the vacuum pins include one of: a flat edge, a serrated edge, an undulating edge, an irregular edge, a mitered edge, and a bristled edge.

5. The apparatus of claim 1, wherein the vacuum pins and the passages therethrough have circular cross-sectional profiles.

6. The apparatus of claim 1, wherein the vacuum pins and the passages therethrough have square cross-sectional profiles.

7. The apparatus of claim 1, wherein the vacuum pins and the passages therethrough have hexagonal cross-sectional profiles.

8. The apparatus of claim 1, further comprising the vacuum source.

9. The apparatus of claim 1, wherein the plurality of apertures are arranged in a pattern that matches a pattern of ventilation holes in a chassis of an electrical component.

10. A vacuum kit, comprising:

a plurality of vacuum housings, each vacuum housing including:

a housing having a first side, a second side, and defining a plenum therein, wherein the first side includes a plurality of apertures therethrough, wherein the plurality of apertures are in communication with the plenum, wherein the second side includes a port configured to be connectable to a vacuum source; and a plurality of vacuum pins arranged in respective ones of the plurality of apertures, wherein the plurality of apertures include a proximal opening and a distal opening that have dimensions matching dimensions of an exterior surface of the vacuum pins, wherein an interior of the apertures between the proximal opening and the distal opening have dimensions that are larger than the dimensions of the proximal and distal openings, wherein each of the plurality of vacuum pins includes a base portion engaging an aperture and a tip end extending away from an outward-facing surface of the first side, wherein the vacuum pins include passages therethrough from the tip end to the base portion, wherein the vacuum pins are moveable between a first position and a second position relative to the apertures, wherein the tip ends extend away from the outward-facing surface of the first side by a greater amount in the first position than the second position, wherein the vacuum pins include a first ridge extending away from the exterior surface at a location between the proximal and distal openings of the aperture, wherein the vacuum pins include a second ridge extending away from the exterior surface at a location in the plenum such that the proximal opening is between the first ridge and the second ridge, and wherein the first ridge and the second ridge cannot pass through the proximal opening or the distal opening, and wherein the first ridge is discontinuous around a perimeter of the exterior surface of the vacuum pin, wherein at least one of a pattern of the apertures, a spacing of the apertures, a cross-sectional dimension of the vacuum pins, and a cross-sectional shape of the vacuum pins for the respective ones of the plurality of vacuum housings differs from remaining ones of the plurality of vacuum housings.

11. The vacuum kit of claim 10, further comprising the vacuum source configured to be connected to the ports on the second sides of the respective vacuum housings.

12. The vacuum kit of claim 10, wherein the plurality of apertures of the plurality of vacuum housings are arranged in a pattern that matches a pattern of ventilation holes in a different computer chassis.

13. A method for cleaning an interior of an electrical component, comprising:

providing a vacuum device, comprising:

a housing having a first side, a second side, and defining a plenum therein, wherein the first side includes a plurality of apertures therethrough, wherein the plurality of apertures are in communication with the plenum, wherein the second side includes a port configured to be connectable to a vacuum source; and a plurality of vacuum pins arranged in respective ones of the plurality of apertures, wherein the plurality of apertures include a proximal opening and a distal opening that have dimensions matching dimensions of an exterior surface of the vacuum pins, wherein an interior of the apertures between the proximal opening and the distal opening have dimensions that are larger than the dimensions of the proximal and distal openings, wherein each of the plurality of vacuum pins includes a base portion engaging an aperture and a tip end extending away from an outward-facing surface of the first side, wherein the vacuum pins include passages therethrough from the tip end to the base portion, wherein the vacuum pins are moveable between a first position and a second position relative to the apertures, wherein the tip ends extend away from the outward-facing surface of the first side by a greater amount in the first position than the second position, wherein the vacuum pins include a first ridge extending away from the exterior surface at a location between the proximal and distal openings of the aperture, wherein the vacuum pins include a second ridge extending away from the exterior surface at a location in the plenum such that the proximal opening is between the first ridge and the second ridge, and wherein the first ridge and the second ridge cannot pass through the proximal opening or the distal opening, and wherein the first ridge is discontinuous around a perimeter of the exterior surface of the vacuum pin;

aligning the plurality of vacuum pins of the vacuum device with a first portion of ventilation holes of a chassis of an electrical component;

moving the aligned vacuum device and vacuum pins toward the chassis such that the vacuum pins are inserted through the first portion of ventilation holes and tip ends of the vacuum pins extend into an interior volume of the electrical component; and operating the vacuum source such that debris in the interior of the electrical component is urged through the vacuum pins, through the plenum, and to the vacuum source.

14. The method of claim 13, further comprising:

moving the vacuum device away from the chassis;

aligning the vacuum pins of the vacuum device with at least a second portion of ventilation holes of a chassis of the electrical component;

moving the aligned vacuum device and vacuum pins toward the chassis such that the vacuum pins are inserted through the second portion of ventilation holes and the tip ends of the vacuum pins extend into the interior of the electrical component; and operating the vacuum source such that debris in the interior of the electrical component is urged through the vacuum pins, through the plenum, and to the vacuum source.

15. The method of claim 13, wherein aligning the vacuum device and vacuum pins with a first portion of ventilation holes of a chassis of the electrical component, moving the aligned vacuum device and vacuum pins toward the chassis, and operating the vacuum source are performed while the electrical component is operating.

* * * * *